US005082032A

United States Patent [19]

Crocker

[11] Patent Number: 5,082,032

[45] Date of Patent: Jan. 21, 1992

[54] VOLUMETRIC PACKAGING APPARATUS FOR FROZEN FOOD AND METHOD

[75] Inventor: James F. Crocker, Jefferson, Ga.

[73] Assignee: George W. Massey, Starr, S.C. ; a part interest

[21] Appl. No.: 595,685

[22] Filed: Oct. 1, 1990

Related U.S. Application Data

[63] Continuation of Ser. No. 418,142, Oct. 6, 1989, abandoned.

[51] Int. Cl.[5] ..... B65B 1/20

[52] U.S. Cl. ..... 141/1; 222/305; 222/370; 141/114; 141/177; 141/266; 141/144

[58] Field of Search ..... 141/1, 10, 114, 129, 141/144, 177, 250, 266, 284; 222/305, 370

[56] References Cited

U.S. PATENT DOCUMENTS

| | | | |
|---|---|---|---|
| 2,540,259 | 2/1951 | Haugen | 222/305 |
| 3,217,944 | 11/1965 | Bell et al. | 222/370 X |
| 3,311,140 | 3/1967 | Hughes | 222/370 X |
| 3,477,617 | 11/1969 | Techtmann | 222/370 |
| 3,552,454 | 1/1971 | Deming, Sr. | 222/370 X |
| 3,995,777 | 12/1976 | Diez et al. | 222/370 |
| 4,465,016 | 8/1984 | Weber | 222/370 X |
| 4,528,848 | 7/1985 | Hafner | 222/370 X |
| 4,681,484 | 7/1987 | Egger | 222/370 X |
| 4,865,092 | 9/1989 | Reichelt | 141/280 |

*Primary Examiner*—Ernest G. Cusick
*Attorney, Agent, or Firm*—Bailey & Hardaway

[57] ABSTRACT

Apparatus and method for packaging frozen food includes positioning a stationary hopper above a rotating plate having spaced openings receiving frozen food from the hopper and directing same into spaced vertical cylinders of predetermined volume preparatary to discharge, the cylinders and associated parts being constructed of ultra high molecular weight polyethylene and the like to avoid sticking and binding of the frozen food thereon.

8 Claims, 3 Drawing Sheets

VOLUMETRIC PACKAGING APPARATUS FOR FROZEN FOOD AND METHOD

BACKGROUND OF THE INVENTION

The packaging of frozen food of the loose particulate variety generally involves filling tiltable containers. There is a problem of food particles sticking to the material from which the tiltable containers are constructed thus slowing down the packaging operation. Accordingly, it is an important object of the present invention to speed the operation for packaging loose particulate frozen food by providing rotatable cylinders capable of receiving and discharging the frozen food for packaging.

Another important object of the invention is the provision of cylinders which are adjustable to vary the volume receivable therein and constructed of ultra high molecular weight polyethylene to avoid sticking of the frozen food on the cylinders.

Still another important object of the invention is the provision of an arcuate roller moving along a surface defining openings through which the frozen food is fed into the cylinders. A portion of the roller enters the openings for dislodging frozen food having been received from a hopper and which stick at the opening permitting discharge into the packages.

SUMMARY OF THE INVENTION

It has been found that a rotatable assembly containing vertical cylinders constructed of ultra high molecular weight polyethylene may be provided for receiving frozen food having a stationary hopper for discharging through stationary plate means into a bag or other suitable packaging device.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
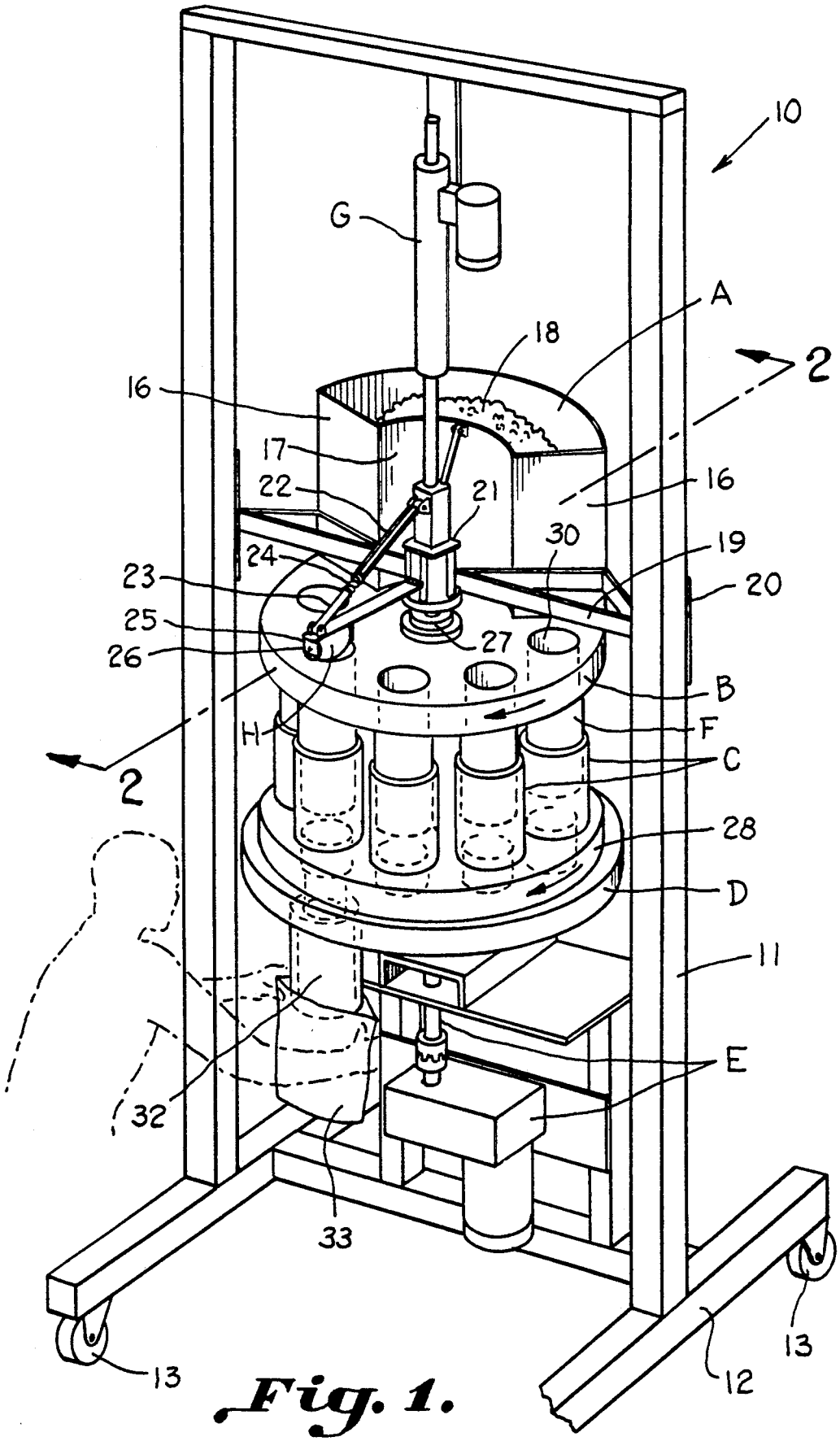
FIG. 1 is a perspective view illustrating packaging apparatus and method constructed in accordance with the present invention.

The drawings illustrate apparatus and method for packaging loose frozen food including a stationary hopper A. A first plate B constructed of ultra high molecular weight polyethylene has a plurality of circumferentially spaced openings therein in register with the hopper. A plurality of circumferentially spaced vertical hollow cylindrical members C each capable of receiving a predetermined volume of frozen food are positioned below and in register with the openings in said first plate. A second stationary plate D also constructed of ultra high molecular weight polyethylene is positioned below the cylinders having an opening therein sequentially registering with the cylindrical members. A drive E rotates the first plate and cylindrical members as a unit. The cylindrical members are machined being constructed of ultra high molecular weight polyethylene and the like and include telescoping members F received therein for vertical sliding movement for varying the volume of frozen food which respective cylinders are capable of receiving. The telescoping members have wall thicknesses different from that of the cylindrical members. Power operated means G control the vertical positioning of the telescoping members F. Arcuate means H are biased for extending into a top of the cylinders loosening the material for discharge.

The apparatus is illustrated as being carried upon a vertical frame broadly designated at 10. The frame 10 includes a pair of spaced frame members 11 defining a vertical standard carried by a horizontal support formed of spaced horizontal members 12 carrying wheels 13 at each corner. The hopper A receives frozen food from a conveyor 14 through a chute 15.

The hopper A is generally donut shaped having vertical end walls 16 and an arcuate inner surface 17 opposite an outer wall 18 defining an opening for receiving the frozen food therein. The stationary hopper A is mounted upon a horizontal frame member 19 which is vertically slidable upon a plastic surface 20 carried by members 11 forming the vertical standard. A support housing 21 is secured to the frame member 19 and to the hopper A. The housing 21 carries a pivotal link 22 having an end portion 23 pivoted by a spring member 24. The arcuate member 23 has a depending frame member 25 carrying the arcuate rotatable member H upon a horizontal shaft 26. These members are slidable in respect to a shaft 27. The first plate B is constructed of ultra high molecular weight polyethylene and is spaced below the hopper and carries telescoping members F received within the cylindrical members C for varying the volume of frozen food. It will be noted that the wall thickness of the cylindrical member F may be different from that of the wall thickness of cylindrical members C carried by the assembly plate 28. The assembly plate 28 is also preferably constructed of ultra high molecular weight polyethylene and positions the vertical hollow cylindrical members C in circumferentially spaced relation. The assembly plate 28 has openings 29 therein for accommodating the cylinders C, and the frozen food is received within the openings 30 within the telescopic member F.

Figure 2:
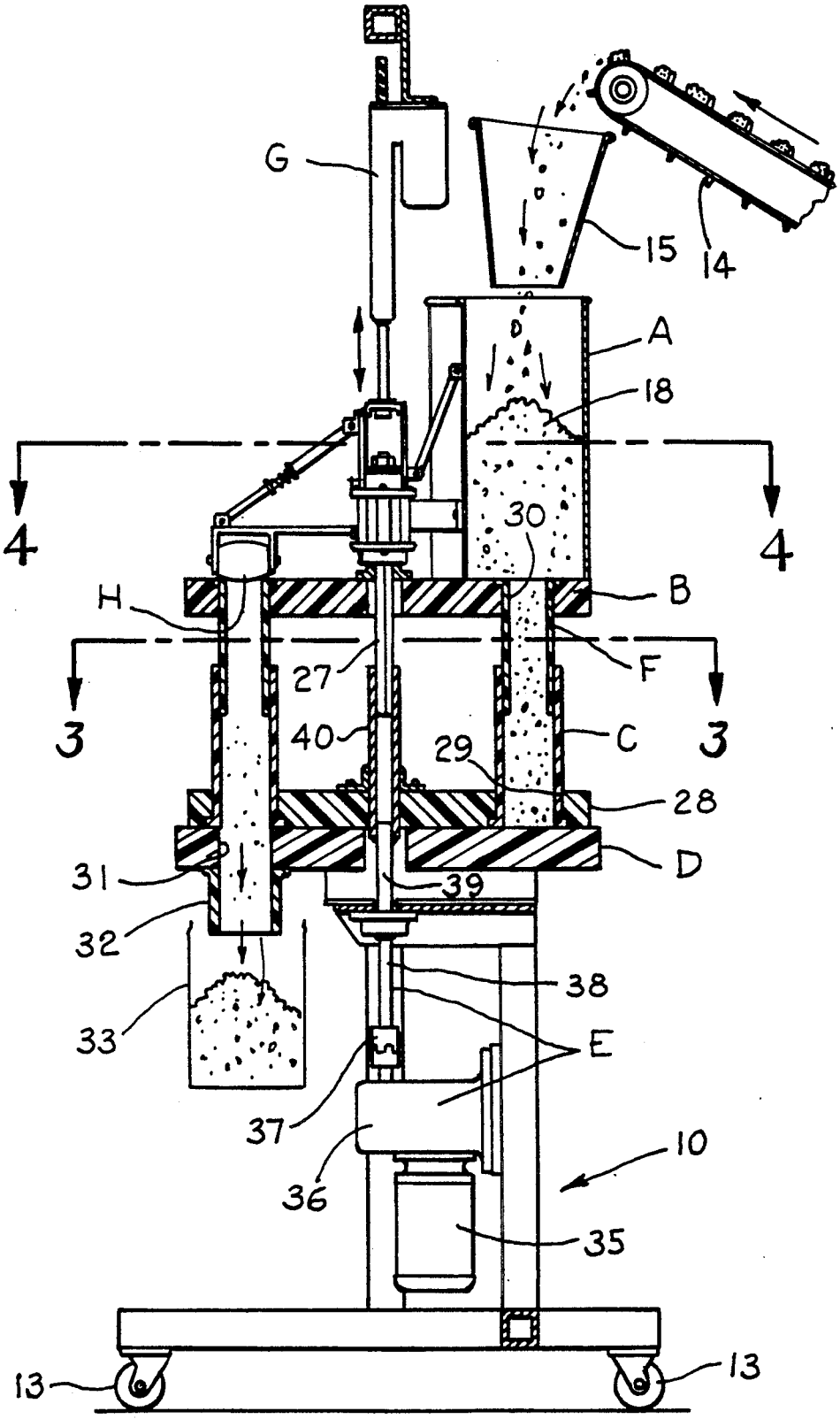
FIG. 2 is a sectional elevation taken along the lines 2—2 in FIG. 1.
Figure 3:
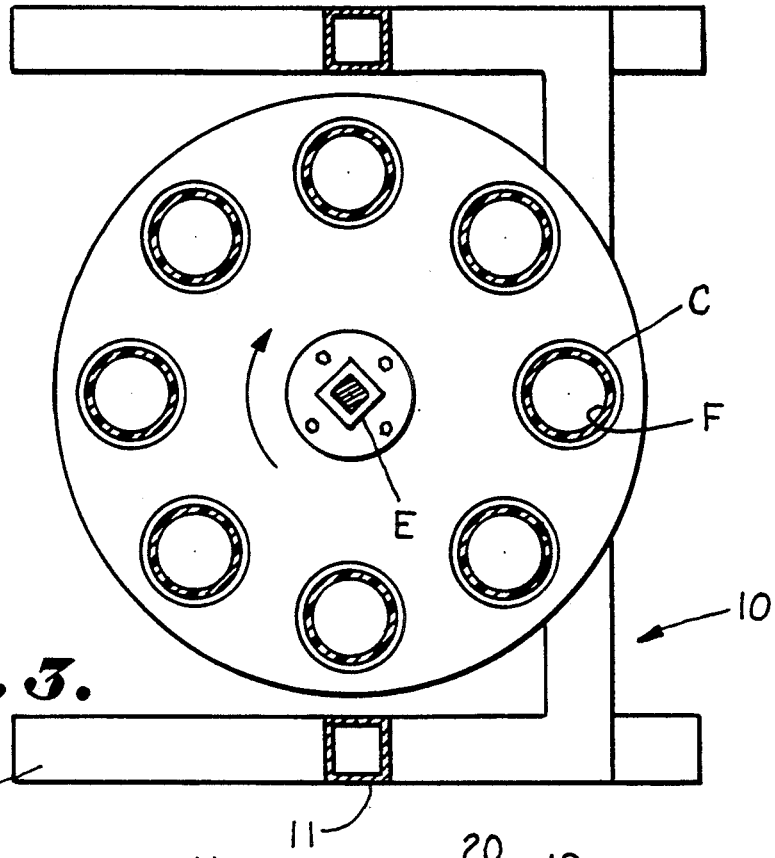
FIG. 3 is a sectional view taken along the lines 3—3 in FIG. 2.
Figure 4:
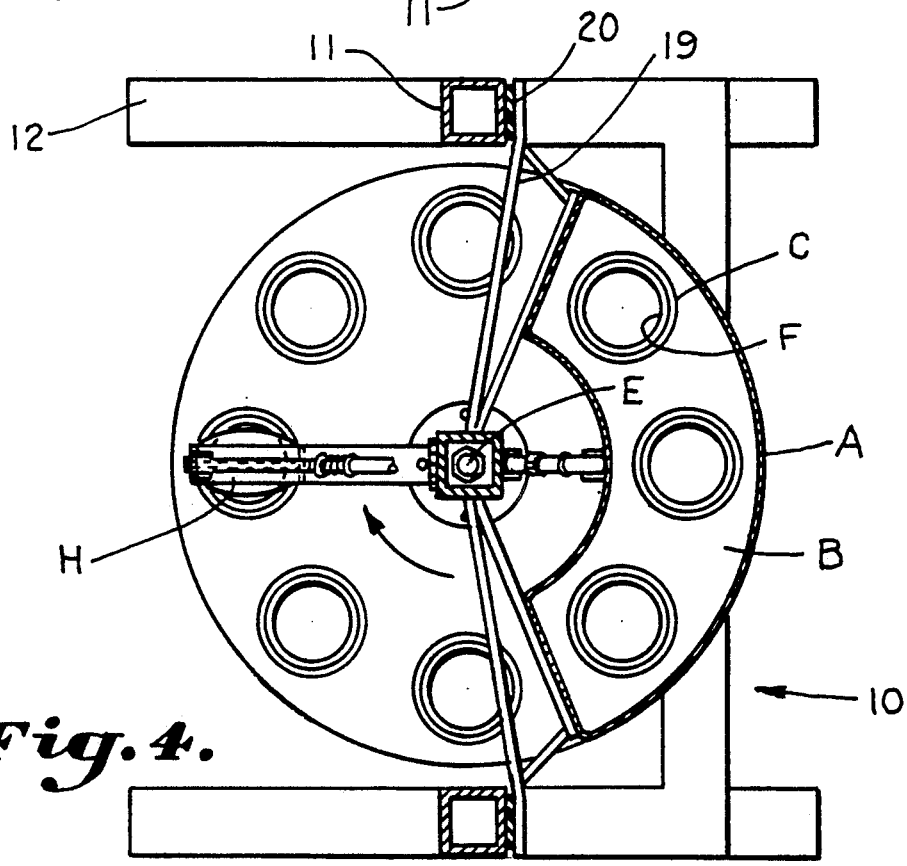
FIG. 4 is a sectional view taken along the lines 4—4 in FIG. 2.

The member H is rolled along the upper surface of the first plate B for dislodging frozen food which may be caught in the opening 30 as it is received from the hopper. The second stationary plate D is carried below the assembly plate 28 and is also constructed of ultra high molecular weight polyethylene. At least one opening is illustrated at 31 within the plate D for receiving food and discharging same through a chute 32 into a bag 33 which may be manually positioned for packaging. The bag may be provided with automatic members vertically shaped for automatically positioning the bags. Preferably the entire assembly including arcuate member H, the upper first plate B, the telescopic member F, the cylinders C, the assembly plate 28 and the stationary plate D and discharging member 32 carried thereby would all be constructed of ultra high molecular weight polyethylene. A drive E includes a motor 35, a gear box 36 and a suitable clutch 37 as well as a vertical drive shaft 38 having a suitable vertical adjustable connection through a vertical member 40 (FIG. 2) with the vertical shaft 27. This driving member is provided by rotating the assembly in respect to the stationary hopper and rolling arcuate member H carried thereby.

Power operated means G are provided preferably in the form of a linear actuator for raising and lowering the first plate B and the telescopic members carried thereby to vary the volume receivable by the vertical cylinders which include the telescopically mounted members F both of which define a cylindrical volume.

The method contemplates the steps of feeding the frozen food into a stationary hopper and placing the first plate therebeneath for guiding the frozen food into the circumferentially spaced vertical cylinders which include the vertical adjustable telescopic members by providing a stationary plate therebeneath. A support is provided for the cylindrical members as well as a feeding mechanism for discharging the frozen food into packages. The second stationary plate may be provided in the form of a plate of reduced size so long as means are provided for receiving frozen food from the assembly which includes the circumferentially spaced cylinders.

The apparatus may be separated for clean up without disassembling the entire machine. The ultra high molecular weight polyethylene described preferably has a molecular weight of between 4 and 6 million and is not brittle at temperatures as low as 240° F. below 0. At such temperatures food does not stick to or adhere to the polyethylene. Because of the fact that such material is generally incapable of being molded, it is necessary that the various polyethylene parts be machined.

It is thus seen that an improved volumetric packaging apparatus and method is provided for loose particulate frozen food. The apparatus is capable of packaging at greater speeds and with less food sticking to provide greater wear and reliability.

While a preferred embodiment of the invention had been described using specific terms, such description is for illustrative purposes only, and it is to be understood that changes and variations may be made without departing from the spirit of scope of the following claims.

What is claimed is:

1. The method of packaging a predetermined volume of loose frozen food comprising the steps of:

feeding frozen food into a stationary hopper;

placing a rotatable and vertically movable first plate having a plurality of circumferentially spaced openings therein below and in register with the hopper;

providing below said first plate a rotatable and vertically fixed assembly plate carrying a plurality equal to the number of said first plate openings of circumferentially spaced vertical hollow cylindrical members each capable of receiving a range of volumes within chosen parameters of frozen food below and in register with said openings in the first plate, said cylindrical members including telescoping members carried by said first plate and received therein for vertical sliding movement for varying the volume of frozen food which respective cylinders are capable of receiving;

providing power operated means for raising and lowering said first plate relative to said assembly plate thereby controlling the vertical sliding movement of said telescoping members, said power operated means including a vertical member attached to said assembly plate slidably receiving a shaft attached to and extending below said first plate and further including a linear actuator;

vertically moving said first plate with the power operated means to achieve a selected volume within said cylindrical members;

sequentially introducing said frozen food through the spaced openings into said cylindrical members;

providing a second stationary plate below the cylindrical members having an opening therein sequentially registering with the cylindrical members; and rotating the first plate, the assembly plate, and the cylindrical members as a unit.

2. The method set forth in claim 1 including providing arcuate means biased for extending into a top of said cylinders loosening said material for discharge.

3. The method set forth in claim 1 including providing said telescoping members with wall thicknesses different from that of said cylindrical members.

4. Apparatus for packaging loose frozen food comprising:

a hopper;

a rotatable and vertically movable first plate having a plurality of circumferentially spaced openings therein in register with said hopper;

a rotatable and vertically fixed assembly plate below said first plate carrying a plurality equal to the number of said first plate openings of circumferentially spaced vertical hollow cylindrical members each cylindrical member capable of receiving a predetermined volume of frozen food below and in register with said openings in said first plate;

telescoping members carried by said first plate and received within said cylindrical members for vertical sliding movement for varying the volume of frozen food which respective cylindrical members are capable of receiving;

means for raising and lowering said first plate relative to said assembly plate thereby controlling the vertical sliding movement of said telescoping members relative to said cylindrical members, said means including a vertical member attached to said assembly plate and further including a shaft attached to and extending below said first plate for slidable receiving said vertical member;

a second stationary plate below said cylindrical members having an opening therein sequentially registering with said cylindrical members; and a drive rotating said first plate, said assembly plate, and said cylindrical members as a unit.

5. The structure set forth in claim 4 wherein said telescoping members have wall thicknesses different from that of the cylindrical members.

6. The structure set forth in claim 4 including arcuate means biased for extending into a top of said cylindrical members for loosening said frozen food for discharge.

7. The structure set forth in claim 4 wherein said means for raising and lowering said first plate further comprises a linear actuator.

8. Apparatus for packaging loose frozen food and the like comprising:

a stationary hopper;

a first plate constructed of ultra high molecular weight polyethylene having a plurality of circumferentially spaced openings therein in register with said hopper;

a plurality equal to the number of said first plate openings of circumferentially spaced vertical hollow cylindrical members constructed of ultra high molecular weight polyethylene each capable of receiving a predetermined volume of frozen food below and in register with said openings of said first plate;

a second stationary plate constructed of ultra high molecular weight polyethylene below said cylinders having an opening therein sequentially registering with said cylindrical members; and a drive rotating said first plate and cylindrical members as a unit, wherein the ultra high molecular weight polyethylene reduces occurrences of food sticking to the apparatus thereby allowing for packaging at greater speeds and with greater reliability.

* * * * *